US008401435B2

(12) United States Patent
Shima et al.

(10) Patent No.: US 8,401,435 B2
(45) Date of Patent: Mar. 19, 2013

(54) DEVELOPER SUPPLYING APPARATUS

(75) Inventors: Toshihide Shima, Abiko (JP); Takayuki Kato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 12/757,363

(22) Filed: Apr. 9, 2010

(65) Prior Publication Data

US 2010/0272476 A1 Oct. 28, 2010

(30) Foreign Application Priority Data

Apr. 28, 2009 (JP) ..... 2009-108938

(51) Int. Cl.
*G03G 15/08* (2006.01)

(52) U.S. Cl. ..... 399/258; 399/254

(58) Field of Classification Search ..... 399/254–256, 399/258

See application file for complete search history.

(56) References Cited

U.S. PATENT DOCUMENTS 5,204,721 A 4/1993 Sharpe
5,510,882 A * 4/1996 Kikuta et al. ..... 399/257
6,952,549 B2 10/2005 Kato et al.
7,110,709 B2 9/2006 Kato et al.
2005/0111883 A1* 5/2005 Amano et al. ..... 399/254

FOREIGN PATENT DOCUMENTS

JP 54-24038 A 2/1979
JP 9-185232 A 7/1997
JP 2003-57931 A 2/2003
JP 2005-345858 A 12/2005
JP 2006-72076 A 3/2006

OTHER PUBLICATIONS

Notification of the First Office Action dated Mar. 26, 2012, in Chinese Application No. 201010166152.0.

* cited by examiner

*Primary Examiner* — Hoang Ngo
(74) *Attorney, Agent, or Firm* — Fitzpatrick, Cella, Harper & Scinto

(57) ABSTRACT

A developer supply apparatus includes an accommodating portion for accommodating a developer; a discharge opening for discharging developer from the accommodating portion; a first feeding member, provided in the accommodating portion, for feeding the developer accommodated in the accommodating portion from one end of the accommodating portion toward the other end; and second feeding member, provided at a position remoter from the discharge opening than the first feeding member, for feeding the developer accommodated in the accommodating portion from the one end of the accommodating portion toward the other end; wherein a feeding power of the second feeding member per unit drive time is higher than that of the first feeding member.

6 Claims, 12 Drawing Sheets

DEVELOPER SUPPLYING APPARATUS

FIELD OF THE INVENTION AND RELATED ART

The present invention relates to a developer supplying apparatus which supplies a developing apparatus with the developer taken out of a developer container. More specifically, it relates to a developer supplying apparatus structure which makes it possible to reliably supply a developing apparatus with developer even while a developer container is being replaced.

Image forming apparatuses which form an electrostatic image on their photosensitive members, develop the electrostatic image with developer (toner), into a visible image (which hereafter may be referred to simply as toner image), and transfer the toner image onto recording medium, are widely in use. These image forming apparatuses are provided with a developer supplying apparatus which supplies the developing apparatus with the developer from a developer container as the developer in the image forming apparatus is consumed by an image forming operation.

Patent Japanese Laid-open Patent Application 2003-57931 discloses an image forming apparatus capable of continuing an image forming operation even while the developer container in the apparatus is replaced. More specifically, it is provided with a developer storage portion in which it temporarily stores developer as it takes developer out of the developer container in the apparatus. In operation, it supplies its developing apparatus with a preset amount of the developer from the developer storage portion. This is why it is capable of continuing an image forming operation even while the developer container in the apparatus is being replaced.

Referring to FIG. 3, the developer supplying apparatus holds a cylindrical replaceable developer container 70, one of the lengthwise ends of which has a developer outlet. It makes the developer container 70 discharge the developer in the container 70 out of the developer outlet by rotating the developer container 70 about the rotational axis of the container 70, which is parallel with the lengthwise direction of the developing apparatus 4. As the developer is discharged from the developer container 70, it is temporarily stored in its storage portion 302 (gravity feed hopper) located at one of the lengthwise ends of the developing apparatus 4, and then, is gradually scooped out from the bottom of the storage portion 302 and supplied to the developing apparatus 4.

Japanese Laid-open Patent Application H09-185232 discloses a developer supplying apparatus structured so that a developer container is held in the lower portion of the developer supplying apparatus. In operation, as developer is moved out of the developer container, it is scooped up into the developing apparatus. More specifically, the developer supplying apparatus has a developer conveyance mechanism having a developer conveyance screw, which is at the bottom of the gravity feed hopper. It has also a pneumatic developer conveyance tube. In operation, a preset amount of developer is taken out of the hopper by rotating the developer conveyance screw, and then, is conveyed to the developing apparatus by the pneumatic developer conveyance tube.

Referring to FIG. 10, in the case of the developer supplying apparatus (FIG. 8) disclosed in Japanese Laid-open Patent Application H09-185232, the storage portion 302 (bottom portion of gravity feed hopper) is enlarged by increasing the widthwise dimension of the storage portion 302, that is, the dimension perpendicular to the toner conveyance direction, as shown in FIG. 10. This method of enlarging the storage portion 303 creates the following problem. That is, if the storage portion 302 is provided with only one developer conveying member (304), a certain amount of the toner in the storage portion 302 fails to be conveyed out of the storage portion 302. As one of the means to solve this problem, it is possible to provide the storage portion 202*a* of developer supplying apparatus with two (or more) developer conveying members (213R and 213L) as shown in FIG. 5.

As the storage portion 202*a* is provided with multiple (two) developer conveying members as described above, a body of toner which is conveyed toward a toner outlet 212*a* and a body of toner which is conveyed away from the toner outlet 212*a* are created. Thus, it occurs sometimes when the developer supplying apparatus is insufficient and/or unstable in the amount of developer conveyance force, and therefore, fails to reliably convey toner to the toner outlet 212*a*.

SUMMARY OF THE INVENTION

Thus, the primary object of the present invention is to provide a developer supplying apparatus which has multiple toner conveying members for conveying the toner in the toner storage portion of the apparatus having a toner outlet, from one end of the storage portion to the other, and yet, is capable of preventing the flow of the developer toward the toner outlet from fluctuating.

According to an aspect of the present invention, there is provided a developer supply apparatus comprising an accommodating portion for accommodating a developer; a discharge opening for discharging developer from said accommodating portion; a first feeding member, provided in said accommodating portion, for feeding the developer accommodated in said accommodating portion from one end of said accommodating portion toward the other end; and second feeding member, provided at a position remoter from said discharge opening than said first feeding member, for feeding the developer accommodated in said accommodating portion from the one end of said accommodating portion toward the other end, wherein a feeding power of said second feeding member per unit drive time is higher than that of said first feeding member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. Not only is the present invention applicable to a developer supplying apparatus, such as those in the following embodiments of the present invention, which has a wide powder storage portion in which multiple powder conveying means are disposed in parallel, but also, can be embodied as a developer supplying apparatus, which is partially or entirely different in structure from the developer supplying apparatuses in the following embodiments of the present invention.

In other words, not only can the present invention be embodied in the form of a developer supplying apparatus for a full-color image forming apparatus of the tandem type, which uses an intermediary transfer medium or a recording medium conveying member, but also, a developer supplying apparatus for a full-color image forming apparatus or a monochromatic image forming apparatus, which uses only a single image bearing drum. In the following description of the preferred embodiments of the present invention, the present invention is described with reference to the essential portions of the image forming apparatus, that is, the portions related to the formation and transfer of a toner image. However, the present invention is also applicable to various image forming apparatuses other than those in the preferred embodiments of the present invention. That is, the present invention is also applicable to various printers, copying machines, facsimile machines, multifunction apparatuses, etc., which are made of various devices, equipments, internal and external shells, in addition to the above-mentioned essential portions, which are necessary to produce an image forming apparatus.

Incidentally, the general items of the image forming apparatuses disclosed in the previously-discussed Patent Documents 1 and 2 will not be illustrated, and also, will not be described.

<Image Forming Apparatus>

Figure 1:
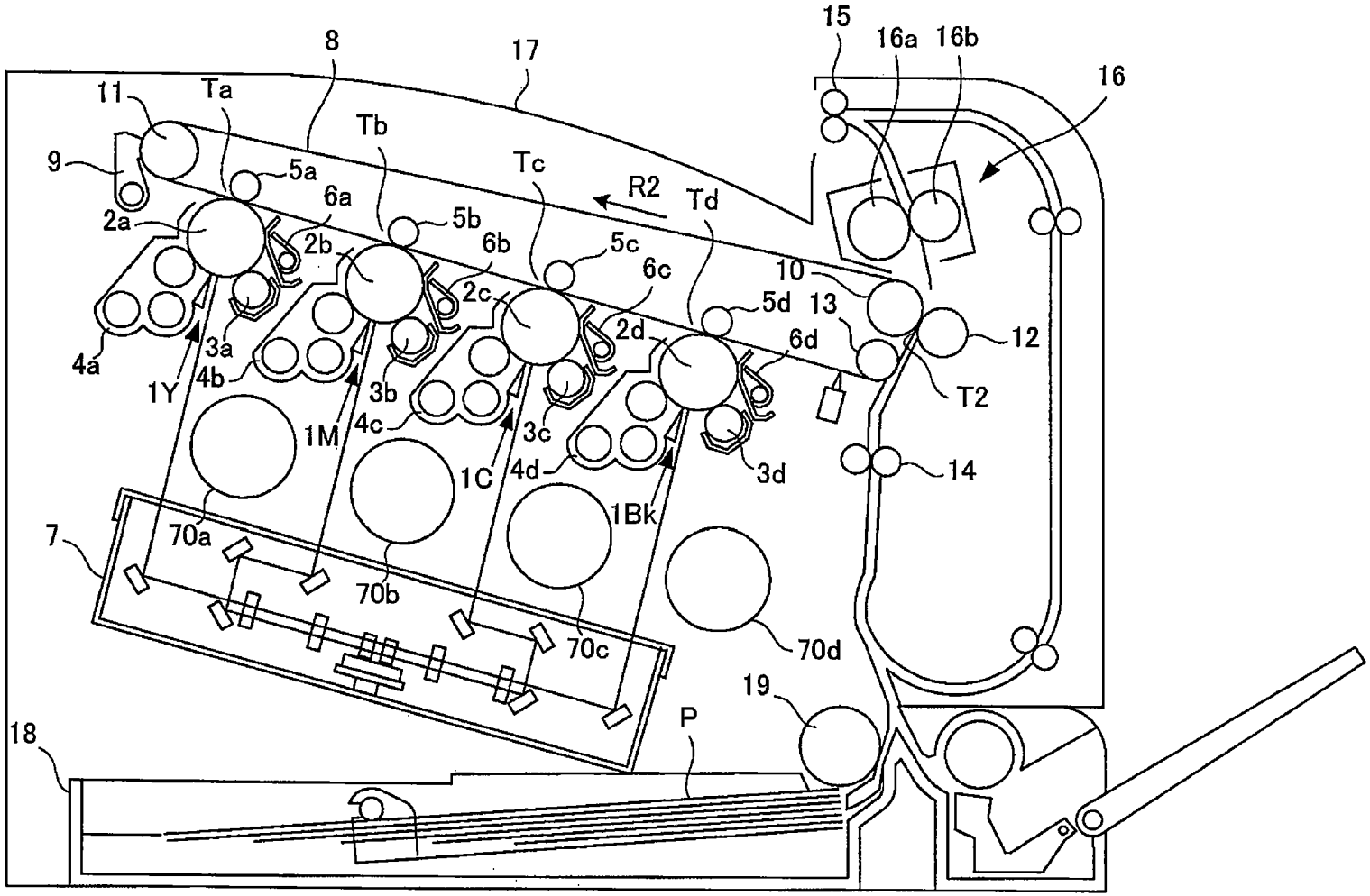
FIG. 1 is a schematic sectional view of the image forming apparatus in the first embodiment of the present invention, and describes the structure of the apparatus.

FIG. 1 is a schematic sectional view of the image forming apparatus in the first embodiment of the present invention, and describes the structure of the apparatus.

Referring to FIG. 1, an image forming apparatus 100 is a full-color printer of the tandem type. It has image forming portions 1Y, 1M, 1C, and 1Bk, and an intermediary transfer belt 8. The image forming portions 1Y, 1M, 1C, and 1Bk are aligned in parallel in the moving direction of the intermediary transfer belt 8, along the downwardly facing surface of the bottom portion of the intermediary transfer belt 8, in terms of the loop which the intermediary transfer belt 8 forms.

In image forming portion 1Y, a yellow toner image is formed on a photosensitive drum 2*a*, and then, is transferred (primary transfer) onto the intermediary transfer belt 8. In image forming portion 1M, a magenta toner image is formed on a photosensitive drum 2*b*, and then, is transferred (primary transfer) onto the intermediary transfer belt 8 so that it is layered upon the yellow toner image on the intermediary transfer belt 8. In image forming portions 1C and 1Bk, cyan and black toner images are formed on photosensitive drums 2*c* and 2*d*, respectively, and then, are sequentially transferred (primary transfer) onto the intermediary transfer belt 8 so that they are layered upon the magenta and yellow toner images on the intermediary transfer belt 8.

After the primary transfer of the four toner images, different in color, onto the intermediary transfer belt 8, the four toner images are conveyed to a secondary transfer portion T2, in which they are transferred (second transfer) all at once onto a sheet P of recording medium (which hereafter will be referred to simply as recording medium P). After the transfer (secondary transfer) of the four toner images, different in color, onto the recording medium P, the recording medium P is conveyed to the fixing apparatus 16, in which the toner images are fixed to the surface of the recording medium P by the application of heat and pressure to the recording medium P and the toner images thereon. Then, the recording medium P is discharged into the top delivery tray 17 by the pair of discharge rollers 15.

The separation roller 19 pulls one or more recording mediums P out of the recording medium cassette 18. It separates one recording medium P out of the rest as it pulls out the recording mediums P. Then, it sends the separated recording medium P to a pair of registration rollers 14, which catches the recording medium P while remaining stationary and keeps the recording medium P on standby. Then, the registration rollers 14 send the recording medium P to the secondary transfer portion T2 with such timing that the recording medium P arrives at the secondary transfer portion T2 at the same time as the toner images on the intermediary transfer belt 8 arrive at the secondary transfer portion T2.

The fixing apparatus 16 has a fixation roller 16*a* and a pressure roller 16*b*. The fixation roller 16*a* has a heater. The fixing apparatus 16 forms a fixation nip by pressing the fixation roller 16*a* and pressure roller 16*b* against each other. As the recording medium P is conveyed through the fixation nip while remaining pinched by the fixation roller 16*a* and 16*b*, the recording medium P and the toner images thereon are subjected to heat and pressure. As a result, the toner images, which make up a full-color image, are melted, and fixed to the surface of the recording medium P.

The image forming portions 1Y, 1M, 1C, and 1Bk are virtually the same in structure although they are different in the color (yellow, magenta, cyan, or black) of the toner used by their developing apparatuses 4*a*, 4*b*, 4*c*, and 4*d*, respectively. In the following description of the preferred embodiments of the present invention, only the image forming portion 1Y will be described, since the description of the other image forming portions 1M, 1C, and 1Bk will be the same as that of the image forming portion 1Y, except for the suffixes b, c, and d which are added in place of the suffix a.

The image forming portion 1Y has the photosensitive drum 2*a*, and photosensitive drum processing means, more specifically, a charge roller 3*a*, an exposing apparatus 7, the developing apparatus 4*a*, a primary transfer roller 5*a*, and a cleaning apparatus 6*a*, which are in the adjacencies of the peripheral surface of the photosensitive drum 2*a*, being positioned in a manner to surround the photosensitive drum 2*a*.

The photosensitive drum 2*a* is made up of an aluminum cylinder, and a photosensitive layer which covers the entirety of the peripheral surface of the aluminum cylinder. The photosensitive layer is negatively charged. The photosensitive drum 2*a* is rotated at a preset speed (process speed) by the driving force transmitted thereto from an unshown motor.

The charge roller 3*a* is rotated by the rotation of the photosensitive drum 2*a*. As an oscillatory voltage, more specifically, a combination of a negative DC voltage and an AC voltage, is applied to the charge roller 3*a* from an unshown electric power source, the portion of the peripheral surface of the photosensitive drum 2*a*, which is in contact with the charge roller 3*a*, is uniformly charged to a preset level of negative polarity.

The exposing apparatus 7 writes an electrostatic image of the image to be formed, on the charged portion of the peripheral surface of the photosensitive drum 2*a*, by scanning the charged portion of the peripheral surface of the photosensitive drum 2*a* with the beam of laser light which it projects while being modulated (turning on or off) with the image data obtained by developing the yellow monochromatic image obtained by separating the image to be formed. The exposing apparatus 7 is made up of a laser light emitting means, a polygon lens, a deflection mirror, etc.

The developing apparatus 4*a* develops the electrostatic image on the photosensitive drum 2*a* into a visible image (image formed of toner; toner image) by transferring negatively charged toner onto the photosensitive drum 2*a* as will be described later.

The primary transfer roller 5*a* forms the primary transfer portion Ta between the photosensitive drum 2*a* and intermediary transfer belt 8 by pressing the intermediary transfer belt 8 upon the photosensitive drum 2*a*. As a positive DC voltage is applied to the primary transfer roller 5*a*, the negatively charged toner image on the photosensitive drum 2*a* is transferred (primary transfer) onto the portion of the intermediary transfer belt 8, which is being moved through the primary transfer portion Ta.

The cleaning apparatus 6*a* removes the transfer residual toner, that is, the toner remaining adhered on the portion of the peripheral surface of the photosensitive drum 2*a*, which is on the downstream side of the primary transfer portion Ta in terms of the rotational direction of the photosensitive drum 2*a*, by rubbing the peripheral surface of the photosensitive drum 2*a* with its cleaning blade.

The intermediary transfer belt 8 is suspended and stretched by a tension roller 11, a driver roller 10, and an auxiliary tension roller 13. The driver roller 10 doubles as the roller for backing up the intermediary transfer belt 8 against a secondary transfer roller 12. The intermediary transfer belt 8 is driven by the driver roller 10 so that it circularly moves in the direction indicated by an arrow mark R2. The intermediary transfer belt 8 is made of dielectric resin film, such as polycarbonate resin film, polyethyleneterephthalate resin film, poly vinylidene fluoride resin film, etc.

The secondary transfer portion T2 is formed by pressing the secondary transfer roller 12 against the driver roller 10, with the presence of the intermediary transfer belt 8 between the secondary transfer roller 12 and the driver roller 10. As a preset amount of positive DC voltage is applied to the secondary transfer roller 12 from an unshown electric power source, an electric field for transferring the toner image is formed between the driver rollers 10, which is grounded, and the secondary transfer roller 12.

The belt cleaning apparatus 9 removes the transfer residual toner, that is, the toner remaining on the portion of the outward surface of the intermediary transfer belt 8, which is on the downstream side of the secondary transfer portion T2, by rubbing the intermediary transfer belt 8 with its cleaning blade.

<Developer Supplying Apparatus>

Figure 2:
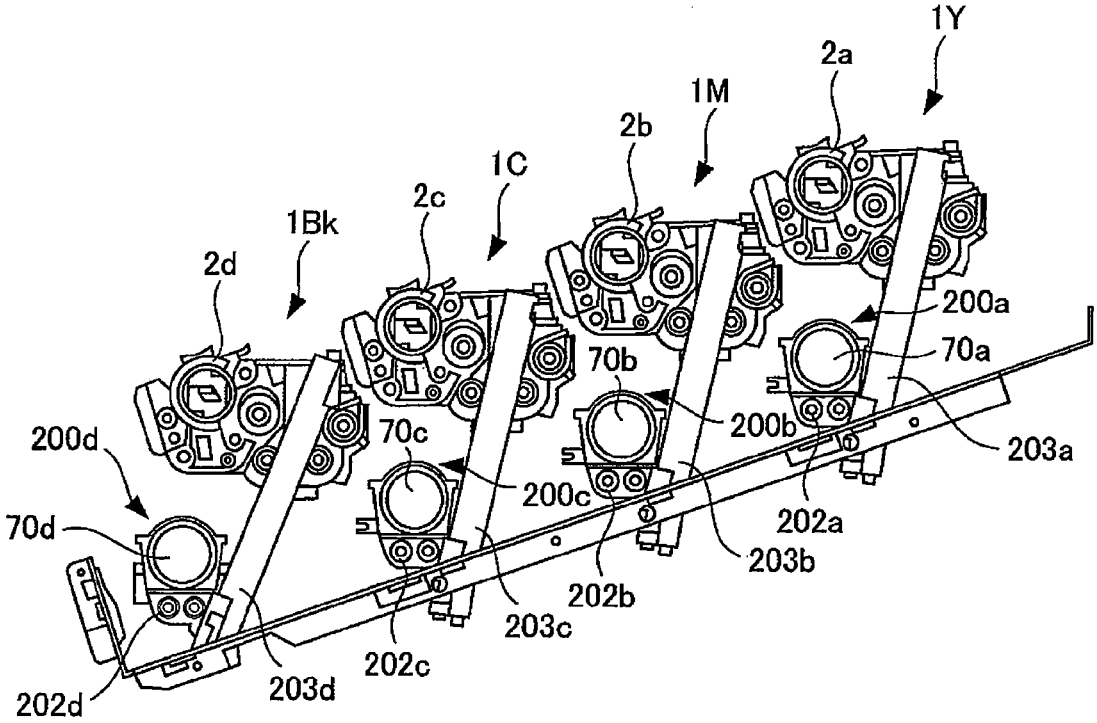
FIG. 2 is a schematic drawing of the image forming portion of the image forming apparatus, as seen from the rear side of the apparatus, and describes the positioning of the developer supplying apparatuses.
Figure 3:
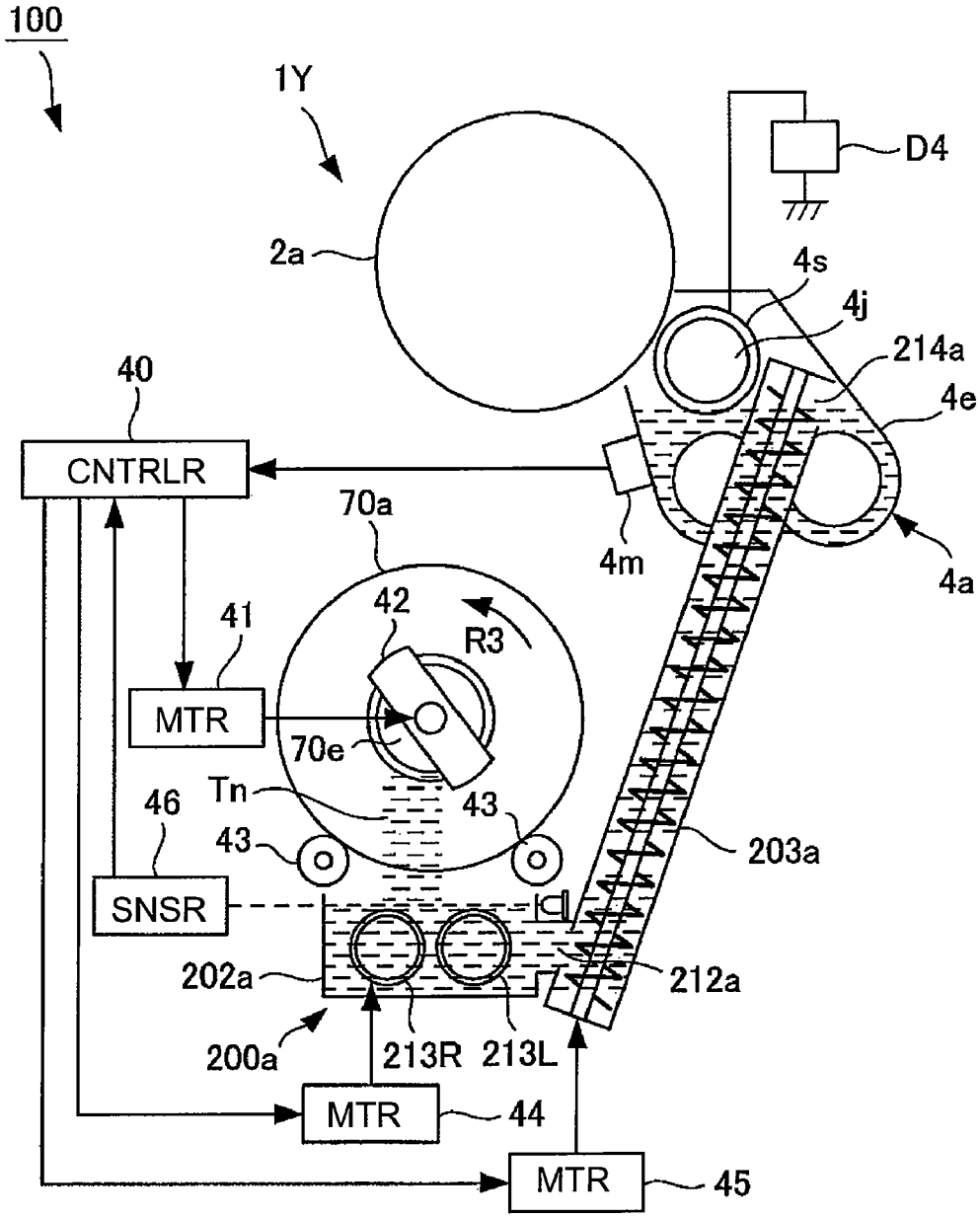
FIG. 3 is a schematic drawing of the developer supplying apparatus.

FIG. 2 is a schematic drawing of the image forming portion of the image forming apparatus as seen from the rear side of the apparatus, and describes the positioning of the developer supplying apparatuses. It primarily shows the developing apparatuses and their developer supplying apparatuses. FIG. 3 is a schematic drawing of the developer supplying apparatus.

Referring to FIG. 1, the toner bottles 70*a*, 70*b*, 70*c*, and 70*d* for the yellow, magenta, cyan, and black toners, respectively, are directly below the photosensitive members 2*a*, 2*b*, 2*c*, and 2*d* for forming the yellow, magenta, cyan, and black monochromatic images, respectively.

Referring to FIG. 2, the developing apparatuses 4*a*, 4*b*, 4*c*, and 4*d* are adjacent to the photosensitive drums 2*a*, 2*b*, 2*c*, and 2*d*, and have developer supplying apparatuses 200*a*, 200*b*, 200*c*, and 200*d*, which supply the developing apparatuses 4*a*, 4*b*, 4*c*, and 4*d* with the yellow, magenta, cyan, and black toners, which were taken out of the toner bottles 70*a*, 70*b*, 70*c*, and 70*d*, respectively.

The developer supplying apparatuses 200*a*, 200*b*, 200*c*, and 200*d* are virtually the same in structure although they are different in the angle of the screw of their developer conveyance mechanisms 203*a*, 203*b*, 203*c*, and 203*d*. Here, therefore, only the developer supplying apparatus 200*a* will be described, since the description of the developer supplying apparatuses 200*b*, 200*c*, and 200*d* is the same as that of the developer supplying apparatus 200*a*, except for suffixes b, c, and d which are in the place of the suffix a.

Referring to FIG. 3, the developing apparatus 4*a* is higher in position than the toner bottle 70*a*. Thus, the toner Tn discharged through the toner outlet 212*a* can be supplied by a preset amount (controlled amount) to the developing apparatus 4*a* through a toner conveyance passage (203*a*). The developer conveyance mechanism 203*a* is a developer conveyance passage which is in connection with the toner outlet 212*a*. It has a conduit and a spiral and rotatable developer conveying member (screw), which is in the conduit. It conveys upward the developer discharged from the toner outlet 212*a*.

The developing apparatus 4*a* uses two-component developer made up of nonmagnetic toner and magnetic carrier, which is in the developer container 4*e*. It negatively charges the nonmagnetic toner, and positively charges the magnetic carrier, by stirring the two-component developer in the developer container 4*e*. The charged two-component developer is borne on the development sleeve 4*s*, which is being rotated around a stationary magnet 4*j*. Thus, as the development sleeve 4*s* rotates, the charged two-component developer on the development sleeves 4*s* rubs the photosensitive drum 2*a*. An electric power source D4 is for applying an oscillatory voltage, which is a combination of a negative DC voltage and an AC voltage to the development sleeve 4*s*. As the oscillatory voltage is applied to the development sleeve 4*s*, the nonmagnetic toner on the development sleeve 4*s* is transferred onto the exposed points of the photosensitive drum 2*a*. Thus, the electrostatic image on the photosensitive drum 2*a* is developed in reverse.

As an image forming operation continues, the nonmagnetic toner in the two-component developer in the developer container 4*e* is consumed. As a result, the two-component developer in the developer container 4*e* increases in magnetic carrier density.

The control portion 40 operates (controls) the developer supplying apparatus 200*a* in response to the output of a toner density sensor 4*m* (magnetic permeability sensor), in such a manner that the weight ratio of the magnetic toner in the developer container 4*e* remains within a range of 3-5%. That is, in order to ensure that the image forming apparatus, which uses two-component developer, forms images of high quality, it is important that the weight ratio between the magnetic carrier and nonmagnetic toner in the developing apparatus 4*a* remains stable so that the image forming apparatus remains stable in image density. In order to keep stable the weight ratio between the magnetic carrier and nonmagnetic toner in the developing apparatus 4*a*, it is necessary to control the amount by which toner is supplied to the developing apparatus 4*a* from the toner bottle 70*a*.

The control portion 40 controls the rotational speed of the developer conveyance screw of the developer conveyance mechanism 203*a*, and also, turns on or off, in response to the toner ratio detected by the toner density sensor 4*m*. Thus, in order to precisely control the amount by which toner is supplied to the developing apparatus 4*a*, it is necessary that toner which is stable in bulk density is reliably supplied to the developing apparatus 4*a* according to the rotational angle of the developer conveyance screw of the developer conveyance mechanism 203*a*.

In order to ensure that the toner supplied to the developing apparatus 4*a* is stable in bulk density, it is necessary to keep the toner in the adjacencies of the toner outlet 212*a* stable in bulk density so that the toner is reliably and continuously sent to the developer conveyance mechanism 302*a* from the storage portion 202*a*.

The developer supplying apparatus 200*a* supplies the developing apparatus 4*a* with the yellow toner as replenishment toner, taken out of the toner bottle 70*a*, that is, an example of a developer container, which is for holding yellow toner. The toner bottle 70*a* is rotatably supported by a supporting portion 43, and is rotated in the direction indicated by an arrow mark R3. As the toner bottle 70*a* is rotated, the toner in the toner bottle 70*a* is conveyed frontward, is pushed out of the toner bottle 70*a* through the toner outlet 70*e*, and falls into the storage portion 202*a* which is below the toner outlet 70*e*.

The toner bottle 70*a* in the first embodiment has a lid 42, which is hinged so that as the toner bottle 70*a* is mounted in the image forming apparatus 100, the lip 42 automatically opens. The toner bottle 70*a* is structured so that as it is rotated, the toner therein is discharged therefrom through its toner outlet 70*e*.

In order to prevent the light passage of the toner amount detection sensor 46 from being blocked by the toner in the storage portion 202*a*, the control portion 40 rotates the toner bottle 70*a* by rotating the lid 42 by activating a motor 41. As the control portion 40 detects (determines) with the use of the toner amount detection sensor 46 in the storage portion 202*a* that there is no toner, it fills the storage portion 202*a* with toner by rotating the toner bottle 70*a* until the toner amount sensor 46 detects (determines) that there is toner in the storage portion 202*a*.

The control portion 40 activates the motor in response to the output of the toner density sensor 4*m* to rotate the toner conveyance screw of the toner conveyance mechanism 203*a* so that the toner in the storage portion 202*a* is scooped up into the developing apparatus 4*a*. Thus, the developing apparatus 4*a* is supplied only by a necessary amount of fresh supply of toner which had been taken out of the toner bottle 70*a*, had been temporarily stored in the storage portion 202*a*, and was delivered by the toner conveyance mechanism 203*a*.

The developer supplying apparatus 200*a* supplies the developing apparatus 4*a* with the developer (Tn) taken out of the developer container (70*a*) which stores the replenishment developer and is mountable into, or dismountable from, the developer supplying apparatus 200*a*.

The storage portion 202*a* is positioned so that as the toner Tn is taken out of the toner bottle 70*a*, the storage portion 202*a* catches the toner Tn by one of its lengthwise ends in terms of the horizontal direction. The toner outlet 212*a* of the storage portion 202*a*, through which the toner Tn is discharged from the storage portion 202*a*, is at the opposite lengthwise end, in terms of the horizontal direction, from the lengthwise end by which the toner Tn from the toner bottle 70*a* is caught.

<Embodiment 1>

Figure 4:
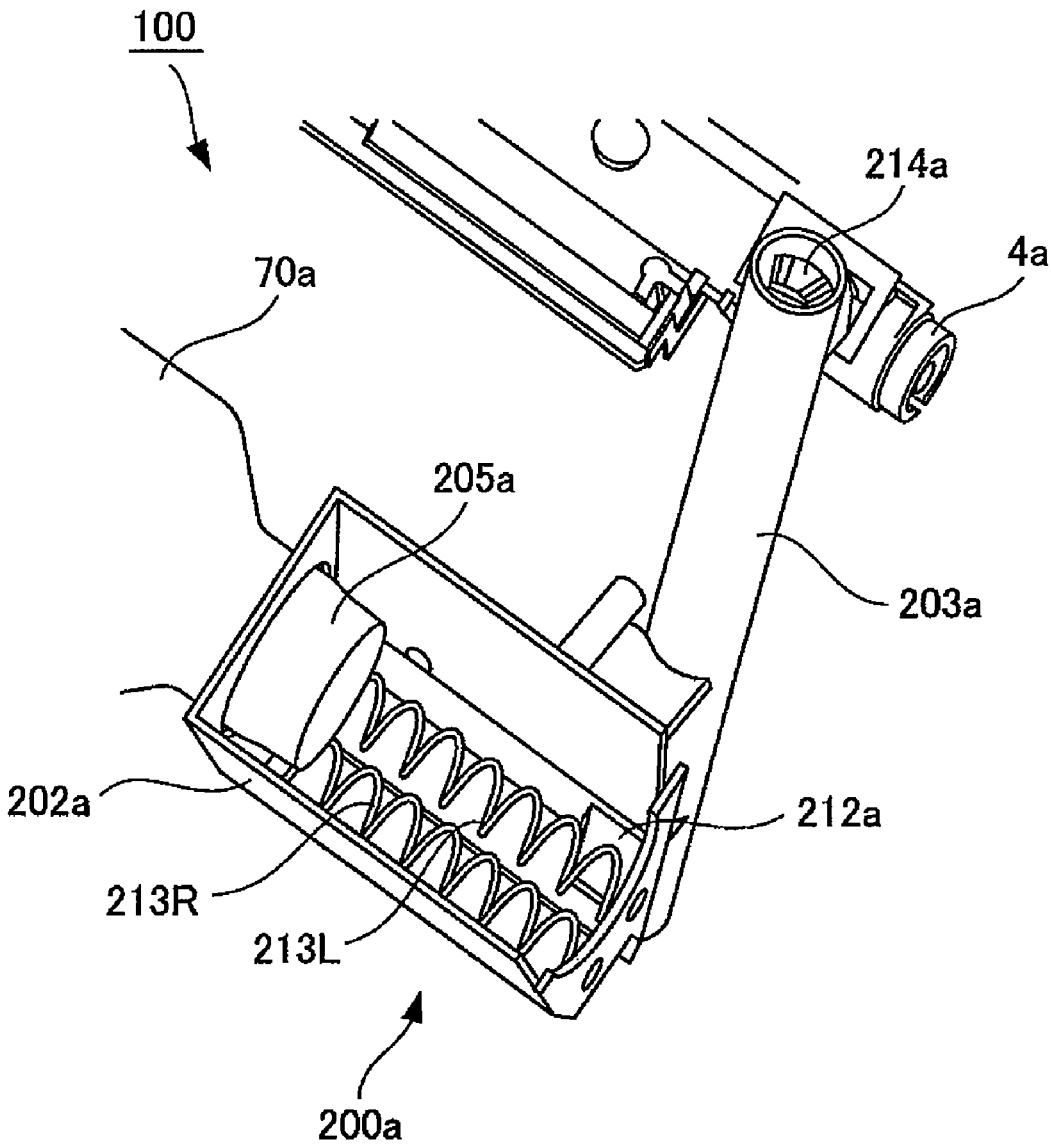
FIG. 4 is a perspective view of the developer supplying apparatus in the first embodiment of the present invention.
Figure 5:
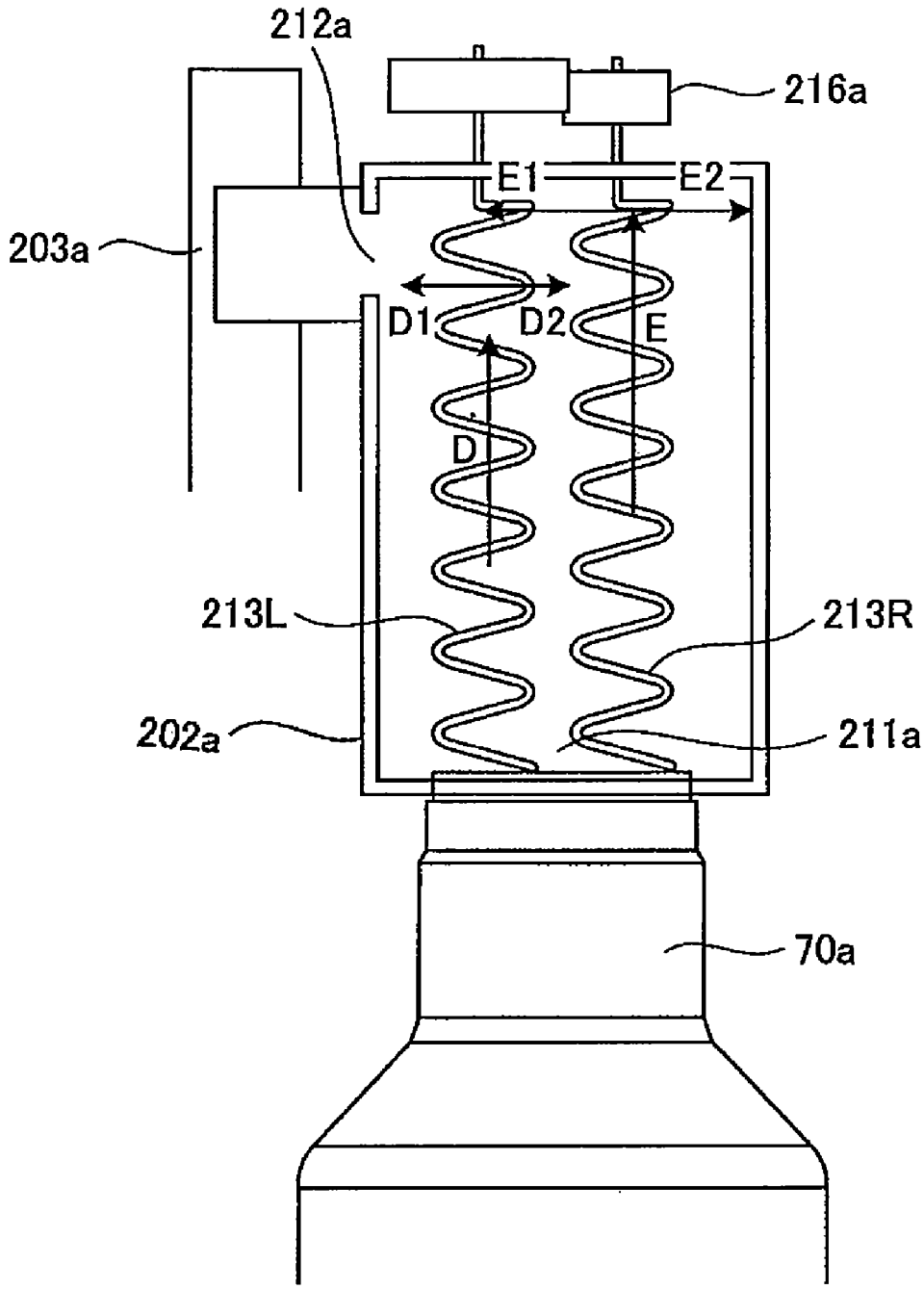
FIG. 5 is a schematic drawing of the developer storage portion in the first embodiment of the present invention, and describes the positioning of the developer conveyance coils in the developer storage portion.
Figure 6:
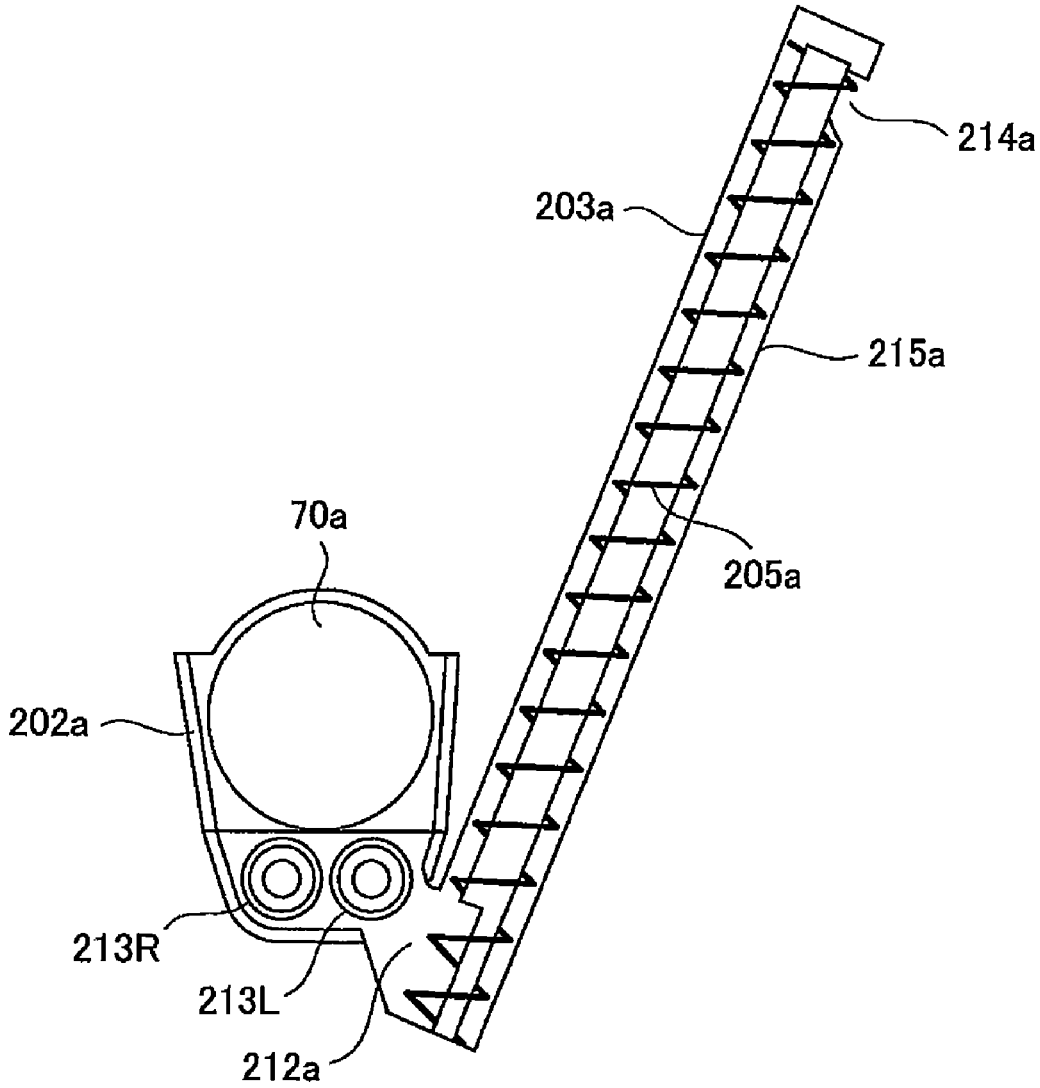
FIG. 6 is a schematic drawing of the developer supplying apparatus, and describes the positioning of the developer conveyance screws of developer conveyance mechanism of the developer supplying apparatus.

FIG. 4 is a perspective view of the developer supplying apparatus in the first embodiment of the present invention. FIG. 5 is a schematic drawing of the developer storage portion in the first embodiment, and describes the positioning of the developer conveyance coils in the developer storage portion. FIG. 6 is a schematic drawing of the developer supplying apparatus, and describes the positioning of the developer conveyance screws of developer conveyance mechanism of the developer supplying apparatus. To put it in another way, FIG. 4 is a drawing of the adjacencies of the storage portion, and FIG. 5 is a top plan view of the storage portion.

FIG. 6 is a vertical sectional view of the developer conveyance mechanism.

Referring to FIG. 4, in the first embodiment, the storage portion 202*a* is as wide as the width of the toner outlet 205*a* of the toner bottle 70*a*, and is positioned so that as the toner bottle 70*a* is mounted, the developer conveyance screws of the developer conveyance mechanism will be below the developer outlet of the toner bottle 70*a*. The toner bottle 70*a* supplies developer to the storage portion 202*a* by being rotated about its rotational axis which is parallel to the lengthwise direction of the developing apparatus 4*a*.

The storage portion 202*a* is in the rear portion of the image forming apparatus 100, and below the developing apparatus 4*a* and toner bottle bottle70*a*. A pair of developer conveyance coils 213R and 213L are in the storage portion 202*a*, and convey the developer (toner) in the storage portion 202*a* in the lengthwise direction of the developing apparatus 4*a* (direction parallel to the rotational axis of toner bottle 70*a*).

The developer supplying apparatus 200*a* is in the form of such a horizontal hopper that as toner is supplied from the toner bottle 70*a* to one of the lengthwise ends of the storage portion 202*a*, the developer conveyance coils 213R and 213L pushes (presses) the toner from the toner bottle 70*a* toward the other lengthwise end of the storage portion 202*a*. The developer conveyance coils 213R and 213L are in the storage portion 202*a*, and convey the developer in the storage portion 202*a* from one of the lengthwise ends of the storage portion 202*a* to the other.

The developer conveyance coil 213L (second developer conveying member) and developer conveyance coil 213R (first developer conveying member) are horizontally positioned next to each other. The toner outlet 212*a*, through which the toner in the storage portion 202*a* is discharged from the storage portion 202*a* to be delivered to the developing apparatus 4*a*, is in the opposite portion of the storage portion 202*a* from the portion of the storage portion 202*a*, into which the developer is delivered from the toner bottle 70*a*, and on the opposite side of the developer conveyance coil L from the developer conveyance coil R. The toner outlet 212*a* is roughly at the same level as the developer conveyance coil 213L (developer conveying second member), and faces the downstream end portion of the coil 213L in terms of the developer conveyance direction in the storage portion 202*a*.

The developer conveyance coils 213R and 213L are spiral rotational members, which are the same in diameter, length, and pitch. However, in terms of developer conveyance performance in the direction parallel to their rotational axes per unit length of coil driving time, the developer conveyance coil 213R (developer conveying first member) is higher than the developer conveyance coil 213L (developer conveying second member). There is a gear mechanism (216*a* in FIG. 5) at the opposite end of the storage portion 202*a* from the toner bottle 70*a*. The gear mechanism 216*a* is structured so that the developer conveyance coils 213R and 213L are driven together, but are made different in number of revolutions per unit length of time to make the developer conveyance coils 213R and 213L different in developer conveyance performance.

As the toner in the storage portion 202*a* is horizontally conveyed from the lengthwise end of the storage portion 202*a*, by which the toner was received from the toner bottle 70*a*, to the other end by the developer conveyance coils 213R and 213L, it flows into the developer conveyance mechanism 203*a*, which is an example of a developer conveying means, through the toner outlet 212*a*, which is at the afore-mentioned other end of the storage portion 202*a*, and in the corner portion between the bottom wall of the storage portion 202*a* and one of the lateral walls of the storage portion 202*a*, which is next to the developer conveyance mechanism 203*a*. The developer conveyance mechanism 203*a* scoops up the toner (which is example of developer) discharged through the toner outlet 212*a*, and conveys the toner up into the developing apparatus 4*a*.

Referring to FIG. 5, the storage portion 202*a* has a toner receiving portion 211*a*, to which the toner is supplied from the toner bottle 70*a*, and which is at one of the lengthwise ends of the storage portion 202*a* in terms of the horizontal direction. It has also the toner outlet 212*a*, through which the received toner (developer) is discharged, and which is at the other lengthwise end. Further, there is the gear mechanism 216*a* at the aforementioned other end of the storage portion 202*a*. Therefore, the toner outlet 212*a* is in the aforementioned lateral wall of the storage portion 202*a*, and the opening of the toner outlet 212*a* is roughly parallel to the axial line of the developer conveyance mechanism 203*a*. Because of the above-described structural arrangement, the developer supplying apparatus 200*a* is very compact in terms of the front-to-rear direction (lengthwise direction) of the developing apparatus 4*a*.

The developer conveyance coils 213R and 213L, which are parallel to each other, convey the toner in the storage portion 202*a* from the toner receiving portion 211*a* toward the toner outlet 212*a*. Incidentally, in the first embodiment, the developer conveyance coils 213R and 213L are in the form of a coil spring. However, the first embodiment is not intended to restrict the shape of the developer conveyance means to that of a coil spring. That is, the developer conveyance coils 213R and 213L may be replaced with a pair of ordinary screws, for example, screws of the blade type, or screws made of a piece of plate spring. Further, the two (or multiple) powder conveying means may be a parallel pair of conveyer belts.

The direction of the toner flow created by the developer conveyance coil 213R is indicated by an arrow mark E, and the direction of the toner flow created by the developer conveyance coil 213R is indicated by an arrow mark D. That is, the toner in the storage portion 202*a* is conveyed from the toner receiving portion 211 toward the toner outlet 212*a* as indicated by the arrow marks D and E. Then, as the toner encounters with the opposite lengthwise end wall of the storage portion 202*a* from the toner receiving portion 211, and is pressed thereupon, it flows in the left and right directions indicated by arrow marks D1, D2, E1, and E2. Regarding the amount by which toner is conveyed per unit length of time by the developer conveyance coil 213R, and that by the developer conveyance coil 213L, the developer supplying apparatus 200*a* is set up so that the developer conveyance coil 213 which is farther from the toner outlet 212*a* for discharging the toner into the developer conveyance screw mechanism 203*a* is greater.

That is, the relationship between amounts D and E by which the toner is conveyed per unit length of time by the developer conveyance coil 213L, that is, the developer conveyance coil 213 which is closer to the developer outlet 212*a*, and the developer conveyance coil 213L, that is, the developer conveyance coil 213 which is farther from the developer outlet 212*a*, respectively, is: D<E.

In the first embodiment, the direction in which the toner in the storage portion 202*a* is conveyed by the developer conveyance coil 213R, and the direction in which the toner is conveyed by the developer conveyance coil 213L, are the same. Therefore, the adjacencies of the toner outlet 212*a* are stable in the bulk density of the toner for the following reason. The toner flow created by the developer conveyance coil 213R in the direction indicated by the arrow mark E is blocked by one of the lateral walls of the storage portion 202*a*. Thus, the toner flow created in the direction indicated by the arrow mark E by the developer conveyance coil 213R virtually ends up flowing only in the direction indicated by the arrow mark E1. Further, as the toner flows in the direction in the direction indicated by the arrow mark E1, it encounters with the toner flow which is created in the direction indicated by the arrow mark D2 by the developer conveyance coil 213L, and which is greater in volume than the toner flow created by the developer conveyance coil 213R. However, because of the above described relationship: D<E, the combination of the body of toner flowed in the direction indicated by the arrow mark E1 by the developer conveyance coil 213R, and the body of toner flowed in the direction indicated by the arrow mark D2 by the developer conveyance coil 213L, flows in the direction indicated by the arrow mark E1. Further, the toner outlet 212*a* is ahead of the body of toner flowed in the direction indicated by the arrow mark D1 and the body of toner flowed in the direction indicated by the arrow mark E1. Therefore, the toner in the storage portion 202*a* is reliably conveyed into the toner outlet 212*a*.

The amount by which toner is conveyed per unit length of time by each of the developer conveyance coils 213R and 213L is determined by the pitch, external diameter, internal diameter, and rotational speed of the developer conveyance coil 213, and the diameter of the wire of which the developer conveyance coil 213 is made. Thus, the amount by which toner is conveyed by the developer conveyance coil 213 can be increased with the use of at least one among the method of increasing the developer conveyance coil 213 in rotational speed, method of increasing the developer conveyance coil 213 in pitch, and method of increasing the developer conveyance coil 213 in the size of its toner pushing area in terms of its cross section. As the means for increasing the developer conveyance coil 213 in the size of its toner pushing area in terms of its cross section, it is possible to use the method of increasing the developer conveyance coil 213 in external diameter, method of decreasing the developer conveyance coil 213 in internal diameter, method of increasing the 213 in the diameter of the wire of which the developer conveyance coil 213 is made, and/or the like method.

In the first embodiment, both the developer conveyance coils 213R and 213L are 9 mm in pitch, 10 mm in external diameter, 1 mm in coil wire diameter. In other words, they are identical. However, the gear mechanism 216*a* is specifically set in gear ratio so that the developer conveyance coil 213L, that is, the developer conveyance coil 213 which is closer to the toner outlet 212*a* becomes 4 rps in rotational speed, whereas the developer conveyance coil 213R, that is, the developer conveyance coil 213 which is farther from the toner outlet 212*a*, becomes faster in rotational speed to 4.5 rps.

Also in this embodiment, the storage portion 202*a* is 25 mm in width, 60 mm in the dimension in the developer conveyance direction, and 40 mm in height.

Next, referring to FIG. 6, in this embodiment, the developer supplying means for supplying the developing apparatus 4*a* with a preset amount of toner is the developer conveyance mechanism 203*a* which uses a blade screw 205*a* which is 12 mm in diameter. The developer conveyance mechanism 203*a* conveys the toner upward from the storage portion 202*a* to the developing apparatus 4*a*.

The developer conveyance mechanism 203*a* has a pipe 215*a* (conduit) which connects the toner outlet 212*a* of the storage portion 202*a* and the inlet portion 214*a* of the developing apparatus 4*a*. It has also a toner conveyance screw 205*a* of the blade type, which is in the pipe 215*a*. The developer conveyance mechanism 203*a* has to be capable of supplying the developing apparatus 4*a* with the toner by an amount which is equal to the amount by which the toner was consumed by the developing apparatus (4*a* in FIG. 2). In order to properly adjust the amount by which the toner is supplied to the developing apparatus 4*a* by the developer conveyance mechanism 203*a*, it is mandatory that the developer conveyance mechanism 203*a* remains full of toner.

Regarding the above-mentioned mandate, the developer conveyance coils 213R and 213L reliably convey the toner into the toner outlet 212*a*, and therefore, the body of toner in the developer conveyance mechanism 203*a* remains stable in the bulk density per pitch of the blade type screw 205*a*. Therefore, the developing apparatus 4*a* is supplied with toner by a preset amount which corresponds to the rotational angle of the blade type screw 205*a*. This is why the image forming apparatus 100 in this embodiment is stable in image density.

<Examples of Comparative Developer Supplying Apparatus>

Figure 7:
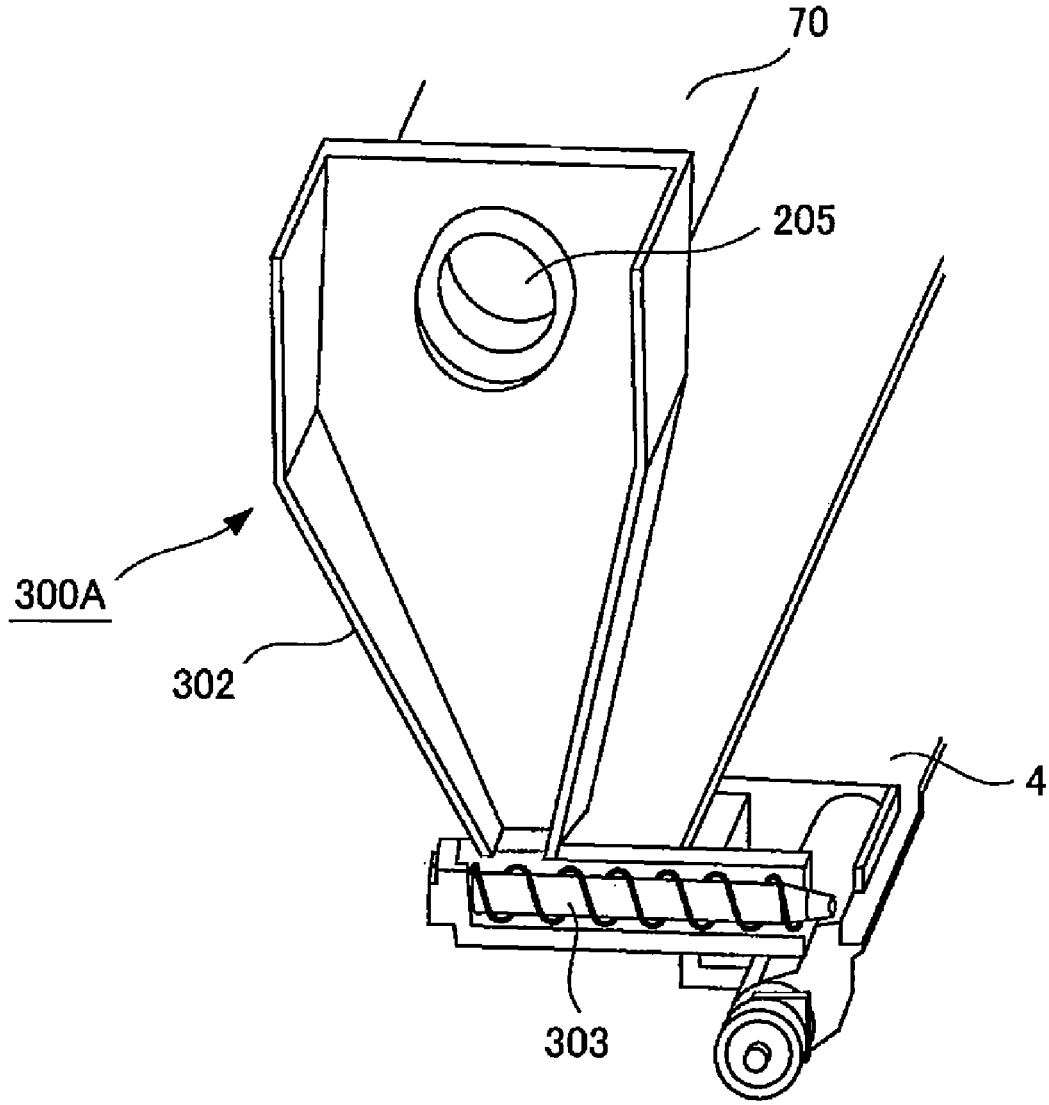
FIG. 7 is a schematic perspective view of the first example of a comparative developer supplying apparatus.
Figure 8:
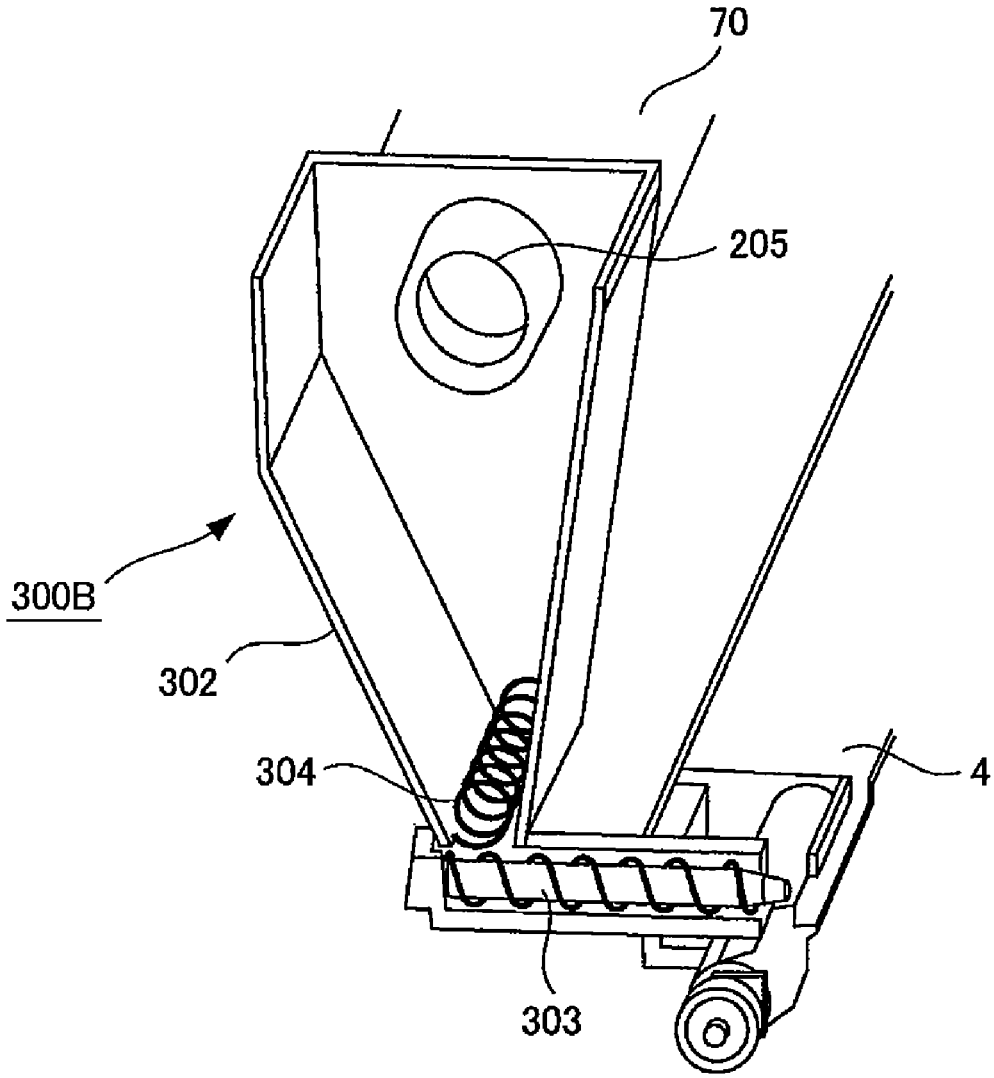
FIG. 8 is a schematic perspective view of the second example of a comparative developer supplying apparatus.
Figure 9:
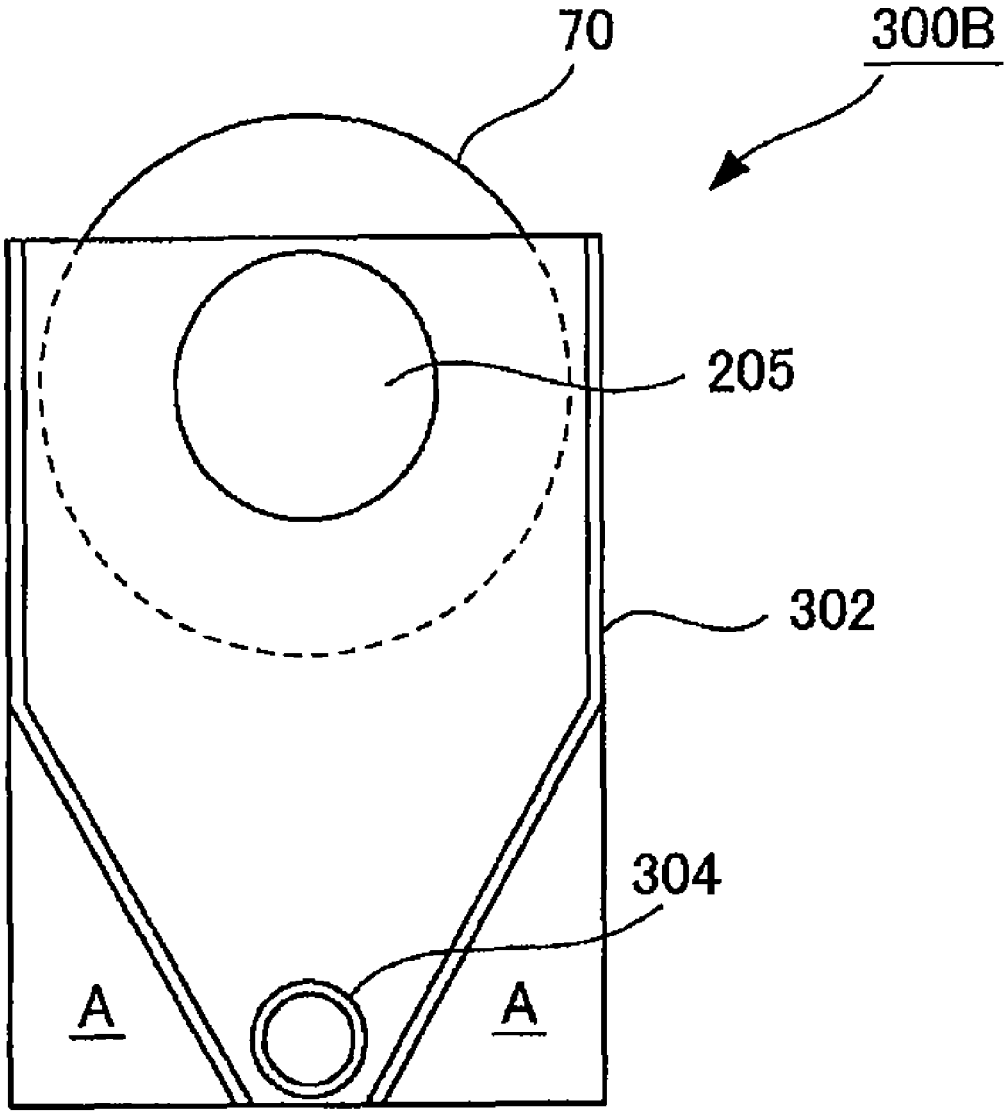
FIG. 9 is a schematic sectional view of the second example of the comparative developing apparatus, and describes the useless space in the apparatus.
Figure 10:
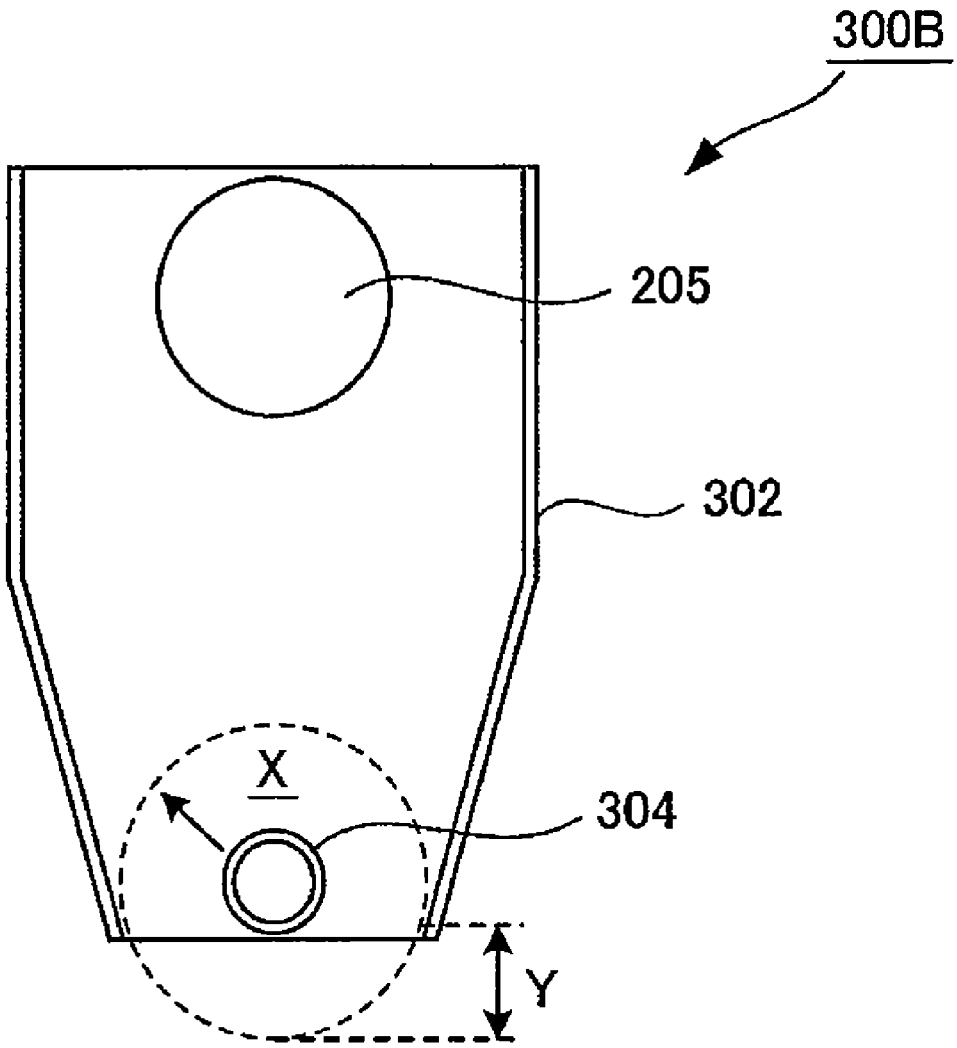
FIG. 10 is a schematic sectional view of the second example of the comparative developing apparatus after the elimination of the useless space, and describes the problem(s) caused by the elimination.

FIG. 7 is a schematic perspective view of the first example of a comparative developer supplying apparatus, and FIG. 8 is a schematic perspective view of the second example of a comparative developer supplying apparatus. FIG. 9 is a schematic sectional view of the second example of the comparative developer supplying apparatus, and describe the useless space in the apparatus. FIG. 10 is a schematic sectional view of the second example of the comparative developer supplying apparatus after the elimination of the useless space, and describes the problems caused by the elimination.

Referring to FIG. 7, in the case of the first example of the comparative developer supplying apparatus 300A, the toner taken out of the toner bottle 70*a* in the top portion of the developing apparatus 4 is temporarily stored in its storage portion 302 (gravity feed hopper). The toner in the storage portion 302 is supplied to the developing apparatus 4 by a preset amount by rotating the developer conveyance mechanism 303 which is in the bottom portion of the storage portion 302.

In terms of the direction parallel to the lengthwise direction of the developing apparatus 4, the dimension of the storage portion 302 of the first example of the comparative developer supplying apparatus 300A is less than that of the storage portion 202*a* of the developer supplying apparatus in the first embodiment. Therefore, an attempt to increase the storage portion 302 in toner capacity to allow the toner bottle 70*a* to be replaced even while images are made, makes the storage portion 302 taller. In other words, the employment of the first example of the comparative developer supplying apparatus makes it difficult to produce image forming apparatuses which are lower in height and smaller in overall size. Further, in the case of a tall storage portion such as the storage portion 302, the body of developer in the storage portion (302) is compacted by gravity while an image forming apparatus is not in use, and therefore, becomes partially higher in density.

If the body of developer in the storage portion (302) partially increases in density, it is possible that as the developer conveyance mechanism (303) begins to be rotated at the beginning of the next image forming operation, the developer will be supplied to the developing apparatus (4) all at once by an amount which is substantially greater than the preset amount. That is, the increase in the capacity of the storage portion (302) makes it possible to replace the toner bottle 70*a* in the image forming apparatus 100, without stopping the image forming apparatus, as the toner bottle 70*a* runs out of the developer. Therefore, the increase in the capacity of the storage portion (302) can improve an image forming apparatus in usability.

Further, in order to develop an electrostatic latent image into a visible image of high quality with the use of two-component developer, it is necessary to keep stable the weight ratio between the magnetic carrier and nonmagnetic toner in the developing apparatus 4. The larger the storage portion 302 in capacity, the more stable in bulk density the body of developer as it is delivered to the developer conveyance mechanism 303, and therefore, the more desirable in terms of the stability in the amount by which the nonmagnetic toner is supplied to the developing apparatus 4 by the developer conveyance mechanism 303. In order to reliably supply the developing apparatus 4 with toner by the developer conveyance mechanism 303, it is necessary to keep the toner in the storage portion 302 stable in bulk density. Therefore, it is necessary for the storage portion 302 to be large enough in developer capacity, in order to prevent the bulk density of the toner in the developer in the storage portion 302 from being significantly affected by the toner consumption.

However, increasing the storage portion 302 in developer capacity simply by making the storage portion taller causes the developer in the bottom portion of the storage portion 302 to be increased in bulk density by the weight of the entire developer in the storage portion 302. Therefore, it is not desirable.

Next, referring to FIG. 8, in the case of a developer supplying apparatus 300B, which is the second example of the comparative developer supplying apparatus, the developer capacity required of the storage portion 302 is secured by increasing the dimension of the storage portion 302 in the direction parallel to the lengthwise direction of the developing apparatus 4 instead of increasing the storage portion 302 in height. Thus, the storage portion 302 of the developer supplying apparatus 300B is less in height than the storage portion 302 of the developer supplying apparatus 300A, that is, the first example of the comparative developer supplying apparatus. Therefore, this structural arrangement is advantageous from the standpoint of producing an image forming apparatus which is less in height and smaller in overall size.

Further, the less the storage portion 302 in height, the less the amount by which the developer in the bottom portion of the storage portion 302 is increased in bulk density by the weight of the entirety of the developer in the storage portion 302 while the image forming apparatus is not in operation.

In the case of the developer supplying apparatus 300B, as toner is pushed out of the toner bottle 70, it is made to fall into the storage portion 302 by gravity, and accumulates in the storage portion 302. Then, the developer conveyance coil 304 in the bottom portion of the storage portion 302 delivers the toner (developer) to the developer conveyance mechanism 303. Then, the delivered toner is supplied to the developing apparatus 4 by the developer conveyance mechanism 303. The bottom portion of the storage portion 302 has been increased in toner (developer) capacity by an amount proportional to the length of the developer conveyance coil 304, which reliably conveys the developer in the storage portion 302 to the developer outlet, which is in connection to the developer inlet of the developer conveyance mechanism 303. Therefore, the body of toner in the adjacencies of the developer outlet of the storage portion 302 (as well as adjacencies of developer inlet of developer conveyance screw mechanism 303) remain stable in bulk density, and therefore, the amount by which toner is sent to the developing apparatus 4 remains stable.

However, also in the case of the second example of the comparative developer supplying apparatus, the storage portion 302 is in the form of a hopper into which toner is made to fall by gravity. Thus, the second example is no different from the first example in that the developer in the bottom portion of the storage portion 302 increases in bulk density while the image forming apparatus is not in use. As described above, if the developer in the storage portion 302 changes in bulk density, the amount by which the developer conveyance mechanism 303 conveys the developer to the developing apparatus 4 becomes unstable.

In the case of the storage portion 302, which is in the form of a hopper of the gravity feed type, the developer in the storage portion 302 tends to change in bulk density while the developer remains unstirred. Thus, the developer supplying apparatus which employs a storage portion which is in the form of a hopper of the gravity feed type is likely to be unstable in the amount by which it sends the developer to the developing apparatus 4.

In recent years, image forming apparatuses have been reduced in the size of their main assembly. With the reduction in the size of the main assembly, the developing apparatus 4 and developer supplying apparatus 300B, which make up a part of the image forming portion, have come to be integrated. Therefore, it has become difficult to provide the storage portion 302 of the developer supplying apparatus 300*b* with a satisfactory amount of developer capacity. Further, the recent increase in the operational speed of an image forming apparatus has increased the speed at which developer is consumed. Therefore, the amount by which developer is to be left in the storage portion 302 to be consumed while the toner bottle 70 in the developing apparatus 4 is replaced as the bottle 70 runs out of the toner had to be increased. Thus, it is required to increase the storage portion 302 in developer capacity.

Next, referring to FIG. 9, if the storage portion 302 is in the form of a hopper of the gravity feed type, it gradually narrows toward the bottom. Thus, the employment of the storage portion 302 which is in the form of a hopper the gravity feed type creates a useless space A in the developing apparatus 4. The creation of the useless space A is unavoidable in order to shape the storage portion 302 so that the developer in the storage portion 302 is made to flow, by gravity, into the developer outlet, which is at the bottom of the storage portion 302 and is connection to the developer conveyance mechanism 303. However, it is undesirable from the standpoint of reducing the main assembly of an image forming apparatus in size.

Thus, in order to make the useless space A as small as possible, it has been proposed to simply expand the bottom portion of the storage portion 302 as shown in FIG. 10. This proposal, however, is problematic in that it interferes with the developer conveyance by the developer conveyance coil 304. That is, it is problematic in that a space (useless space) from which developer is not conveyed out by the developer conveyance coil 304 is created in the storage portion 302 by the expansion. In other words, some developer in the storage portion 302 remains stagnant in the bottom portion of the storage portion 302, and therefore, fails to be used for image formation; it is wasted. The stagnant developer in the storage portion 302, that is, the developer which failed to be moved out of the bottom portion of the storage portion 302, remains compacted in the bottom portion of the storage portion 302 for a long time. Therefore, it is possible that the developer will have reduced in chargeability. If developer which is low in chargeability temporarily flows into the developer conveyance mechanism 303 from the storage portion 302, and then, is supplied to the developing apparatus 4, it is possible that the image forming apparatus will become unstable in image quality.

Thus, in order to prevent developer from becoming stagnant in the bottom portion of the storage portion 302, it was proposed to increase the developer conveyance coil 304 in diameter as outlined by a dashed line as shown in FIG. 10. This proposal is not desirable in that it makes the storage portion 302 taller by a height Y. The second example of the comparative developer supplying apparatus is structured (shaped) so that the storage portion 302 narrows toward its developer outlet which is in connection with the developer conveyance mechanism 303. Therefore, it creates a useless space in the adjacencies of the bottom portion of the storage portion 302. However, the expansion of the bottom portion of the storage portion 302 in its width direction creates the space in which developer becomes stagnant, in the storage portion 302. Thus, if the developer outlet is in one of the lateral walls of the storage portion 302, the expansion makes it difficult to send all the developer in the storage portion 302 into the developer conveyance mechanism 303.

In comparison, in the first embodiment, the storage portion 202*a* was provided with the pair of developer conveyance coils 213R and 213L, which were disposed in parallel to each other in the storage portion 202*a*, in order to provide the storage portion 202*a* with a satisfactory amount of developer capacity. Parallelly placing the pair of developer conveyance coils 213R and 213 makes it unnecessary to make the storage portion 202*a* taller in order to increase the storage portion 202*a* in developer capacity, and also, does not create a useless space, such as the useless spaces created by the structural arrangement of the first and second example of the comparative developer supplying apparatus. Therefore, it can produce a main assembly for an image forming apparatus, which is substantially smaller than the main assembly of an image forming apparatus based on the prior arts, and yet, the storage portion of which is substantially larger than the storage portion of the main assembly of an image forming apparatus based on the prior arts.

Next, referring to FIGS. 7 and 8, in the case of the first and second examples of the comparative developer supplying apparatus, developer is filled into the storage portion 202*a* by gravity. Therefore, developer is simply and statically pushed into the bottom portion of the storage portion 202*a*. Thus, if the developer outlet is in one of the lateral walls of the storage portion 302, it is difficult for the developer in the storage portion 302 to be efficiently moved out of the storage portion 302. In addition, the developer is sent into the developer conveyance mechanism 303 only by gravity. Therefore, the toner bottle 70, storage portion 302, developer conveyance mechanism 303, and developing apparatus 4 have to be positioned so that they vertically align in the listed order, listing from the top.

In the first embodiment, however, the developing apparatus 4*a* is positioned highest, and the toner is conveyed upward by the developer conveyance screw mechanism 203*a*, as shown in FIG. 2. Further, the gear mechanism 216*a* is at the opposite lengthwise end of the storage portion 202*a* from the lengthwise end of the storage portion 202*a*, by which developer is received from the toner bottle 70*a*. Thus, the developer outlet (212*a*) cannot be attached to the end wall which is adjacent to the developer conveyance mechanism 203*a*. In other words, where the toner outlet 212*a*, which connects to the developer conveyance screw mechanism 302*a*, can be placed is nothing but one of the lateral walls of the storage portion 202*a*.

The developer supplying apparatus in the first embodiment is structured so that the developer in the storage portion 202*a* is dynamically sent out through the toner outlet 212*a* by mechanically flowing the developer with the developer conveyance coils 213R and 213L. Therefore, the amount by which the developer is delivered to the developer conveyance mechanism 203*a* remains stable, making it possible for the developer conveyance mechanism 203*a* to uninterruptedly and reliably convey upward the developer that is stable in bulk density.

Also regarding the structure of the developer supplying apparatus in the first embodiment, the pair of developer conveyance coils 213R and 213L are parallelly placed in the bottom portion of the storage portion 202*a*. Therefore, it is possible to provide the storage portion 202*a* with the maximum amount of developer capacity by expanding the bottom portion of the storage portion 202*a* only in its widthwise direction instead of in its height direction. Thus, the first embodiment affords more latitude in the device placement in the adjacencies of the storage portion 202*a*, which in turn contributes to manufacturing a main assembly for an image forming apparatus, which is substantially smaller in size and higher in usability than the main assembly of an image forming apparatus based on the prior arts.

Also regarding the structure of the developer supplying apparatus in the first embodiment, the first embodiment makes it possible to maximize the amount by which the store portion 202*a* can keep the toner therein as buffer, by maximumly utilizing the limited amount of space, achieve the size reduction of the main assembly of an image forming apparatus, and improve an image forming apparatus in usability. At the same time, the first embodiment stabilizes the amount by which toner is supplied to the developing apparatus 4*a* by the developer conveyance screw mechanism 203*a*, by stabilizing the adjacencies of the toner outlet 212*a* of the storage portion 202*a*, in the bulk density of toner. Therefore, the image forming apparatus in the first embodiment can continuously form high quality images even during the replacement of the toner bottle 70*a*.

Also regarding the structure of the developer supplying apparatus in the first embodiment, the developer in the adjacencies of the toner outlet 212*a* which is in connection to the developer conveyance mechanism 203*a* is kept stable in bulk density, by structuring the apparatus so that the pair of developer conveyance coils 213R and 213L are the same in the developer conveyance direction.

Further, the developer supplying apparatus in the first embodiment is structured so that, of the pair of developer conveyance coils 213R and 213L, the farther is a developer conveyance coil 213 from the toner outlet 212*a*, the higher in toner conveyance performance. The difference in toner conveyance performance between the pair of developer conveyance coils 213R and 213L creates a continuous flow of toner which flows toward the toner outlet 212*a* from the lengthwise opposite end of the storage portion 202*a*. In other words, areas in which toner becomes stagnant are not created in the storage portion 202*a*. Therefore, the developer conveyance mechanism 203*a* is reliably filled with toner. That is, the present invention can stabilize the amount by which toner is sent into the developer conveyance mechanism 203*a*. Therefore, it contributes to the formation of high quality images.

Also regarding the structure of the developer supplying apparatus in the first embodiment, the developer conveyance mechanism 203*a* conveyed toner upward. This structural arrangement is not intended to limit the present invention in scope. The present invention is for stabilizing in bulk density the developer supplied from the storage portion 202*a* to the developer conveyance mechanism 203*a*, and does not require that the developer conveyance mechanism 203*a* conveys toner in a specific direction. Since the present invention does not require that the developer conveyance mechanism 203*a* conveys toner in a specific direction, it affords more latitude in the positioning of the developing apparatus 4 and also, the positioning of the units (devices) related to the developing apparatus 4, in the adjacencies of the developing apparatus 4.

<Embodiment 2>

Figure 11:
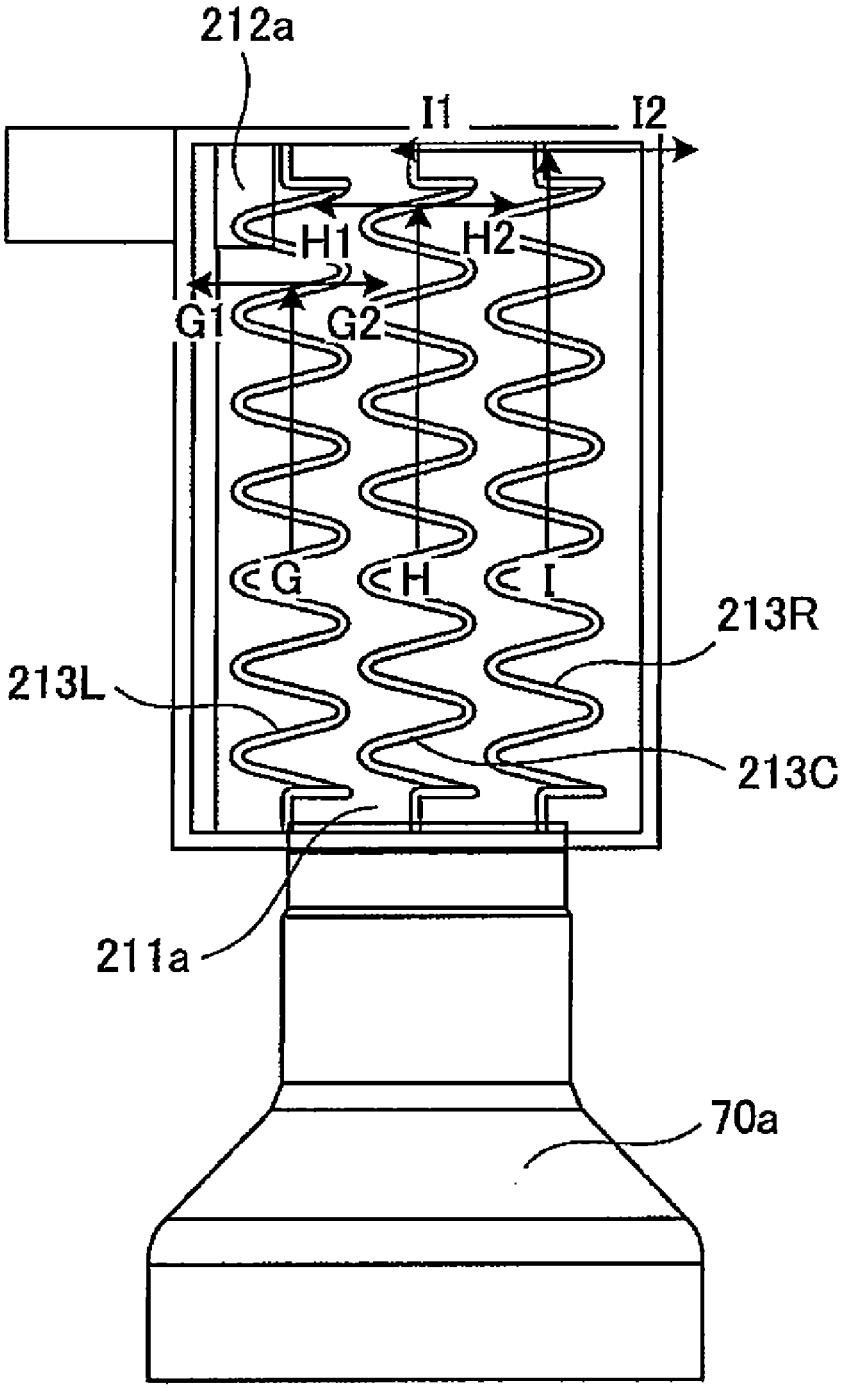
FIG. 11 is a schematic drawing of the developer storage portion in the second embodiment of the present invention, and describes the positioning of the developer conveyance coils in the developer storage portion.

FIG. 11 is a schematic drawing of the developer storage portion in the second embodiment of the present invention, and describes the positioning of the developer conveyance coils in the developer storage portion.

The developer supplying apparatus in the second embodiment is virtually the same in structure as that in the first embodiment, except that the number of the developer conveyance coils in the storage portion 202*a* of the developer supplying apparatus in the second embodiment is three, that is, it is greater by one coil than that in the first embodiment. Thus, the structural components, parts, etc., of the developer supplying apparatus in the second embodiment, which are identical to the counterparts in the first embodiment, will be given the same referential symbols as those given to the counterparts in FIG. 5, and will not be described.

Referring to FIG. 11, in the second embodiment, three developer conveyance coils 213R, 213C, and 213L are positioned in the storage portion 202*a*. The three developer conveyance coils 213R, 213C, and 213L are rotated together by a gear mechanism which is located at the opposite lengthwise end of the storage portion 202*a* from the developer receiving end of the storage portion 202*a*, and the rotational speed of each of the developer conveyance coils 213R, 213C, and 213L is set so that the ratio in rotational speed among the three coils 213R, 213C, and 213L becomes such a ratio that is necessary for proper conveyance of the developer.

Like the storage portion 202*a* in the first embodiment, the downstream end of one of the lateral wall of the storage portion 202*a* in the second embodiment also is provided with the toner outlet 212*a* for discharging the developer in the storage portion 202*a* into the developer conveyance mechanism 203*a*. The three developer conveyance coils 213R, 213C, and 213L horizontally convey the toner which they received from the toner receiving portion 211*a* (which is at the opposite lengthwise end from the toner outlet 212*a*), toward the opposite end, that is, where the toner outlet 212*a* is located.

The rotational speed of each of the three developer conveyance coils 213R, 213C, and 213L is set so that the farther from the toner outlet 212*a* through which the developer is discharged into the developer conveyance mechanism 203*a*, the greater the amount by which toner is conveyed per unit length of time.

When the amounts by which toner is conveyed by the developer conveyance coils 213R, 213C, and 213L are I, H, and G, respectively, there is the following relationship among I, H, and G, because the farther a developer conveyance coil from the toner outlet 212*a* is, the higher it is in toner conveyance performance: G<H<I.

The developer conveyance coil 213R conveys the toner from the toner receiving portion 211*a* toward the opposite lengthwise end wall from the toner receiving portion 211*a* in the direction indicated by an arrow mark I. As the toner encounters the end wall, it tends to flow in the left I1 and right I2 directions. However, there is one of the lateral walls of the storage portion 202*a* in the direction indicated by the arrow mark I2. Thus, most of the toner having encountered the end wall flows in the direction indicated by the arrow mark I1.

The developer conveyance coil 213C conveys the toner from the toner receiving portion 211*a* toward the opposite lengthwise end wall from the toner receiving portion 211*a* in the direction indicated by an arrow mark H. As the toner encounters the end wall, it tends to flow in the left and right directions indicated by arrow marks H1 and H2, respectively. The body of toner which flows in the direction indicated by the arrow mark H2 encounters the body of toner which is substantially larger and flowing in the direction indicated by the arrow mark. Since, H<I, the most of the toner flows in the direction indicated by the arrow mark H1.

The developer conveyance coil 213L conveys the toner from the toner receiving portion 211*a* toward the opposite lengthwise end wall from the toner receiving portion 211*a* in the direction indicated by an arrow mark G. As the toner encounters the end wall, it tends to flow in the left and right directions indicated by arrow marks G1 and G2, respectively. However, G<H. Therefore, the toner flowing in the direction indicated by the arrow mark G2 encounters the toner flow indicated by the arrow mark H1, which is substantially greater in volume. Consequently, the toner conveyed by the developer conveyance coil 213L flows virtually only the direction indicted by the arrow mark G1.

Therefore, the toner in the storage portion 202*a* reliably flows toward the toner outlet 212*a*.

As described above, the developer supplying apparatus in this embodiment is structured so that multiple (three) developer conveyance coils are placed in the storage portion 202*a*, and the further is a developer conveyance coil from the toner outlet 212*a*, the greater it is in the amount by which it conveys toner per unit length of time. Therefore, it is stable in the amount by which toner is sent into its developer conveyance mechanism, contributing therefore to the formation of images which are higher in quality than those formed by image forming apparatuses which employs a developer supplying apparatus based on the prior arts.

<Embodiment 3>

Figure 12:
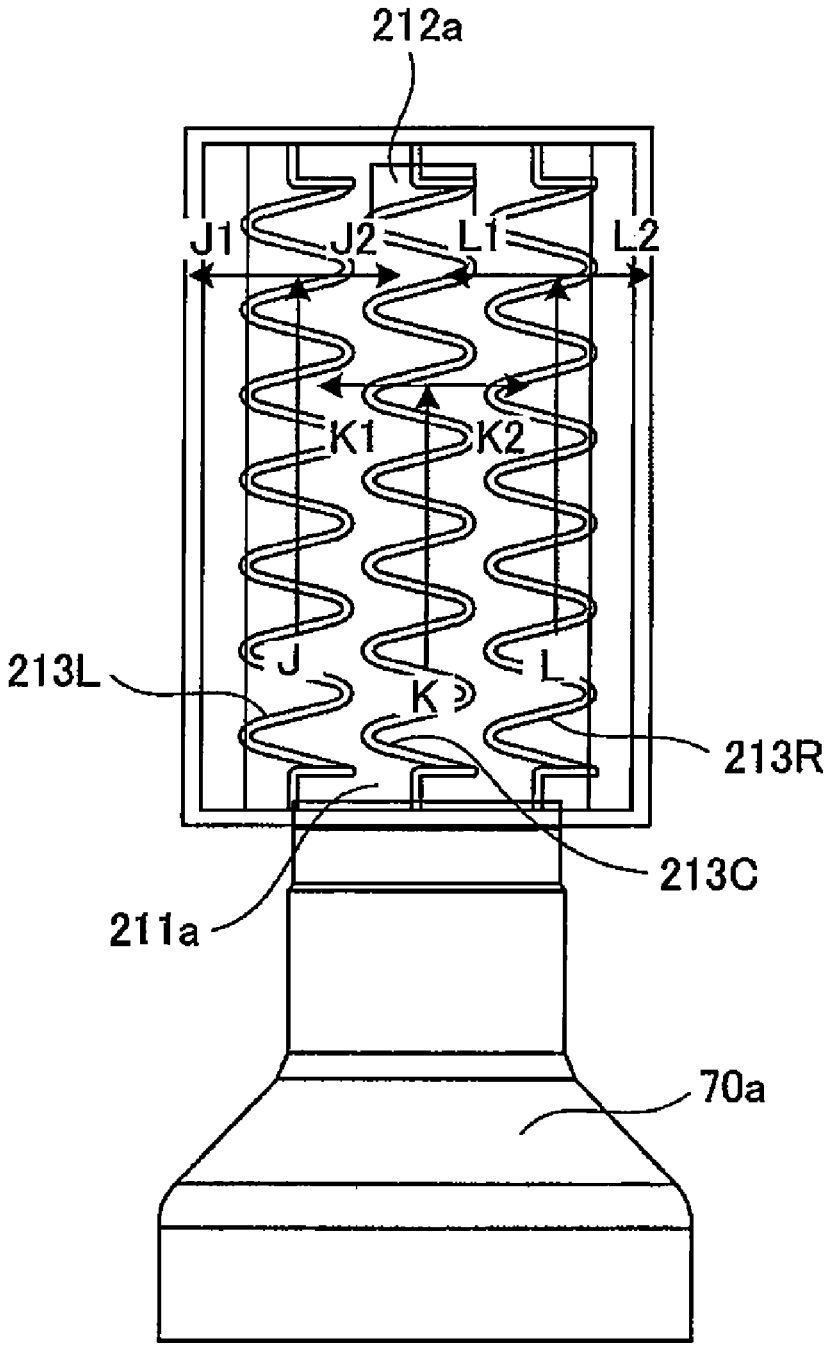
FIG. 12 is a schematic drawing of the developer storage portion in the third embodiment of the present invention, and describes the positioning of the toner outlet of the storage portion, which is in connection with the developer conveyance mechanism.

FIG. 12 is a schematic drawing of the developer storage portion in the third embodiment of the present invention, and describes the positioning of the developer (toner) outlet relative to the developer conveyance mechanism which employs a screw as a developer conveying member.

Referring to FIG. 5, in the first and second embodiments, the toner outlet 212*a* through which the developer in the storage portion 202*a* is discharged into the developer conveyance mechanism 203*a* is on one of the lateral walls of the storage portion 202*a*.

Next, referring to FIG. 12, in the third embodiment, the toner outlet 212*a* which leads to the developer conveyance mechanism 203*a* extends from the center portion of the bottom wall of the storage portion 202*a*. This kind of structural arrangement also can stabilize the amount by which developer is supplied to the developer conveyance mechanism 203*a*.

The amounts by which toner is conveyed by the developer conveyance coils 213R, 313C, and 213L are L, K, and J, respectively. Because the farther a developer conveyance coil is from the toner outlet 212*a*, the higher the developer conveyance coil is in toner conveyance performance, there is the following relationship: J=L>K.

The developer conveyance coil 213R conveys toner from the toner receiving portion 211*a* toward the opposite lengthwise end wall from the toner receiving portion 211*a* in the direction indicated by an arrow mark L. As the toner encounters the end wall, it tends to flow in the left and right directions L1 and L2, respectively. However, there is one of the lateral walls of the storage portion 202*a* in the direction indicated by the arrow mark L2. Thus, virtually only the direction indicated by the arrow mark L1 will be the consequential direction of the toner flow.

The developer conveyance coil 213L conveys toner from the toner receiving portion 211*a* toward the opposite lengthwise end wall from the toner receiving portion 211*a* in the direction indicated by an arrow mark J. As the toner encounters the end wall, it tends to flow in the left and right directions indicated by arrow marks J1 and J2, respectively. However, there is one of the lateral walls of the storage portion 202*a* in the direction indicated by the arrow mark J1. Thus, the consequential direction of the toner flow will be virtually only the direction indicated by the arrow mark J2.

The developer conveyance coil 213C conveys the toner from the toner receiving portion 211*a* toward the opposite lengthwise end wall from the toner receiving portion 211*a* in the direction indicated by an arrow mark K. As the toner encounters the end wall, it tends to flow in the left and right directions indicated by arrow marks K1 and K2, respectively. However, because J=L>K, the toner flow in the direction indicated by the arrow mark K2 encounters the toner flow in the direction indicated by the arrow mark L1, which is substantially larger in volume. Moreover, there is the toner flow which is substantially larger in volume, and the direction of which is indicated by the arrow mark J2, in the direction indicated by the arrow mark K1. Therefore, the direction in which the toner will consequentially flow will be only the vertical direction.

Thus, the toner in the storage portion 202*a* collects in the space occupied by the developer conveyance coil 213*c*, and there is no place for the collected toner to go, except the toner outlet 212*a*. Therefore, the toner will reliably flow toward the toner outlet 213C.

As described above, the amount by which toner is sent into the developer conveyance mechanism can be stabilized by placing two or more developer conveyance coils in the developer storage portion of the developer supplying apparatus, and structuring the developer supplying apparatus so that the farther a developer conveyance coil is from the developer outlet of the storage portion, the greater the coil is in the amount by which it conveys toner per unit length of time. In other words, this embodiment of the present invention also can contribute to the formation of images which are significantly higher in quality than those formed by any of the image forming apparatuses based on the prior arts.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 108938/2009 filed Apr. 28, 2009 which is hereby incorporated by reference.

What is claimed is:

1. A developer supply apparatus comprising:

an accommodating container for accommodating a developer;

a discharge opening for discharging developer from said accommodating container;

a first feeding member, provided at a position opposed to said discharge opening in said accommodating container, for feeding the developer accommodated in said accommodating container from one end of said accommodating container toward the other end of said accommodating container; and a second feeding member, provided adjacent to said first feeding member at a position more remote from said discharge opening than said first feeding member, for feeding the developer accommodated in said accommodating container from the one end of said accommodating container toward the other end, wherein a feeding power of said second feeding member per unit drive time is higher than a feeding power of said first feeding member.

2. An apparatus according to claim 1, wherein said discharge opening is disposed opposed to said second feeding member as viewed in a substantially horizontal direction.

3. An apparatus according to claim 1, further comprising a feeding path, connected with said discharge opening, for upwardly feeding the developer discharged through said discharge opening, and a third feeding member, provided rotatably in said feeding path, for feeding the developer from said feeding path.

4. An apparatus according to claim 1, wherein said first and second feeding members include helical rotatable members, and the feeding power of said first feeding member with respect to a rotational axis direction is higher than the feeding power of said second feeding member.

5. An apparatus according to claim 1, wherein each of said first and second feeding members includes a feeding coil having a same pitch and a same opening diameter, and said first feeding member is higher in a rotational frequency per unit drive time than said second feeding member.

6. An apparatus according to claim 1, wherein said discharge opening is connected with a developing device for developing a latent image on an image bearing member, and the developer discharged through said discharge opening it supplied into the developing device.

* * * * *